US005365631A

United States Patent [19]

Emerick

[11] Patent Number: 5,365,631

[45] Date of Patent: Nov. 22, 1994

[54] ERASER CARRIER

[76] Inventor: Matthew W. Emerick, P.O. Box 83, Port Hope, Mich. 48468

[21] Appl. No.: 89,322

[22] Filed: Jul. 12, 1993

[51] Int. Cl.[5] ..... A47L 13/16

[52] U.S. Cl. ..... 15/105; 15/145; 15/223; 15/244.1; 16/114 R; 294/2; 294/99.1

[58] Field of Search ..... 294/1.1, 2, 29, 33, 294/99.1; 7/124, 164, 169, 170; 15/105, 105.51–105.53, 118, 144.4, 145, 146, 208, 209.1, 210.1, 223, 229.13, 244.1, 424–426; 16/114 R, 115; 84/477 B; 116/306, 307, 327, 328; 135/65, 66, 75; 403/104, 109, 377; 434/408, 417, 428–430, 433

[56] References Cited

U.S. PATENT DOCUMENTS

| | | | |
|---|---|---|---|
| 2,226,949 | 12/1940 | Simpson | 84/477 B |
| 2,249,912 | 7/1941 | Oxley | 15/209.1 |
| 2,641,012 | 6/1953 | Storrs | 16/115 X |
| 2,655,403 | 10/1953 | Ernest | 294/33 |
| 3,110,917 | 11/1963 | McPeek | 15/223 X |
| 3,299,462 | 1/1967 | Mathison | 15/105 X |
| 3,444,579 | 5/1969 | Thomford | 15/210.1 X |
| 3,963,037 | 6/1976 | Clark | 403/109 X |
| 4,314,575 | 2/1982 | Kuo | 135/66 |
| 4,543,680 | 10/1985 | Vlahos | 294/29 X |

*Primary Examiner*—Johnny D. Cherry

[57] ABSTRACT

A carrier for a chalkboard eraser includes a C-shaped eraser holder having a top surface and depending sidewalls which have projections that engage the body of the eraser. A handle is connected to the eraser holder and it has a hollow portion which contains a collapsible pointer. To more positively retain the eraser within the carrier, a lever is pivotally connected to the eraser holder at a first end portion and a second end portion of the lever extends generally parallel to, but is resiliently spaced apart from the handle. The first end of the lever passes through an opening in the eraser holder so that as the second end portion of the lever is squeezed toward the handle, the first end of the lever pivots to positively engage the eraser for maintaining it at a fixed position within the eraser holder.

13 Claims, 4 Drawing Sheets

FIG 3
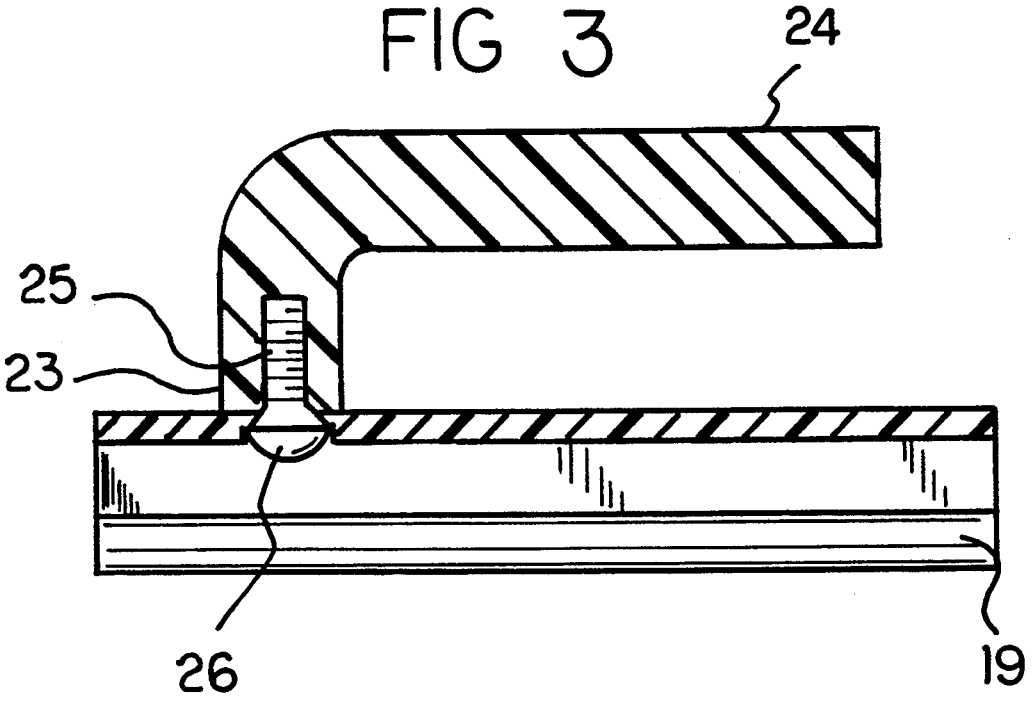
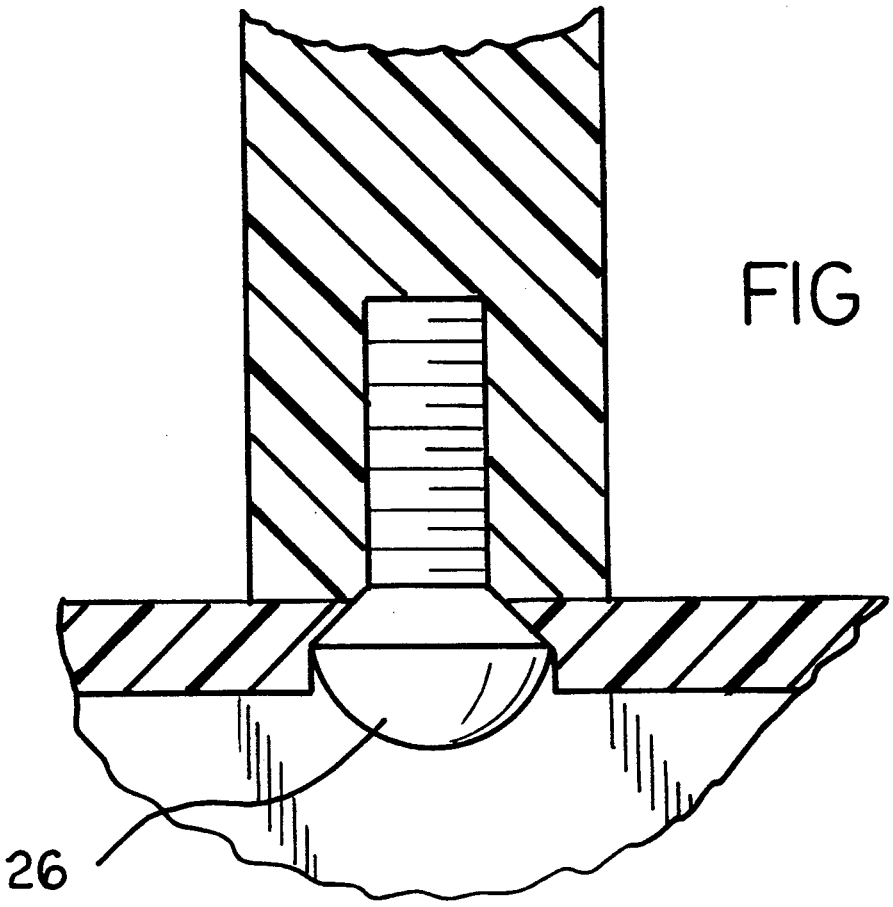
FIG 4

ERASER CARRIER

BACKGROUND OF THE INVENTION

1. Field of the Invention

The present invention relates generally to detachable devices for carrying objects, and more particularly, to a carrying device for detachably retaining an eraser within the device.

2. Description of the Prior Art

Detachable handles for carrying devices are well known. For example, U.S. Pat. No. 4,543,680 discloses a detachable handle for a blackboard eraser which grips a backing plate for the eraser. Other detachable handles for a variety of devices are shown by U.S. Pat. Nos. 3,484,894, 4,754,516, 5,010,615 and 5,059,033. These patents disclose particular handle structures which are specifically configured to accomplish a particular need.

Particular problems encountered in using blackboard or chalkboard erasers, where the user grasps the eraser in one of their hands, include damaged fingernails when the fingernails come into direct contact with the chalkboard; chalk dust which tends to accumulate on the hands and clothing of the user; uneven erasure of the chalkboard due to uneven pressure distributed to the eraser; and tripping and twisting of the eraser in the user's hands. Use of a holder or carrier for the eraser would overcome many problems encountered with direct use of a chalkboard eraser by separating the user's hands from the surface of the chalkboard. Further, a holder or carrier of proper design would allow the user to comfortably erase the chalkboard without the twisting and tripping of the eraser which may occur if the eraser slips from the user's hands. A further advantage of a carrier for a chalkboard eraser is the possibility of incorporating other tools and utensils into the carrier to form a multipurpose chalkboard tool.

The foregoing advantages are accomplished by the unique eraser carrier of the present invention as will be made apparent from the following description thereof. Other advantages of the present invention over the prior art also will be rendered evident.

SUMMARY OF THE INVENTION

To achieve the foregoing and other advantages, the present invention, briefly described, provides a carrier for a chalkboard eraser which is adapted to receive the eraser and which includes a generally C-shaped eraser holder having a top surface and depending sidewalls which have projections that engage the body of the eraser. A handle is connected to the eraser holder and it has a hollow portion which contains a collapsible pointer. To more positively retain the eraser within the carrier, a lever is pivotally connected to the holder at a first end portion and the opposite or second end portion of the lever is configured to extend generally parallel to, but resiliently spaced apart from the handle. The first end of the lever passes through an opening in the holder so that as the second end portion of the lever is squeezed toward the handle, the first end of the lever pivots to positively engage the eraser for maintaining it at a fixed position within the carrier.

The above brief description sets forth rather broadly the more important features of the present invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent construction insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved eraser carrier which has all of the advantages of the prior art and none of the disadvantages.

It is another object of the present invention to provide a new an improved eraser carrier which may be easily and efficiently manufactured and marketed.

It is a further objective of the present invention to provide a new and improved eraser carrier which is of durable and reliable construction.

Still yet a further object of the present invention is to provide a new and improved eraser carrier which is designed to allow the ready insertion or removal of the eraser from the carrier, yet is provided with means to positively maintain the eraser at a fixed position within the carrier.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 3 is a cross-sectional view taken generally along line 3–3 of FIG. 2.

FIG. 4 is an enlarged section view showing the details of the connection between the handle and the holder portion of the carrier.

DESCRIPTION OF THE PREFERRED EMBODIMENT

With reference now to the drawings, a new and improved eraser carrier embodying the principles and concepts of the present invention will be described.

Figure 1:
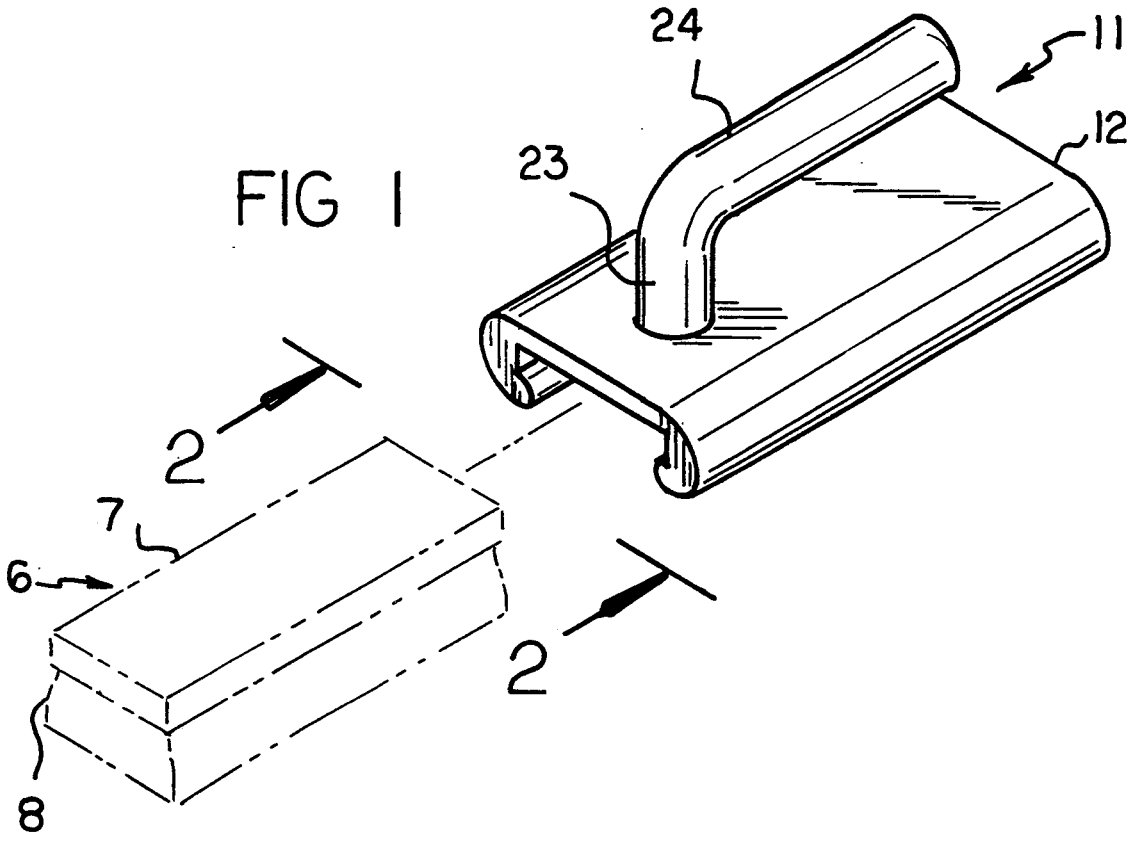
FIG. 1 is a perspective view of the manner in which an eraser is inserted into an eraser carrier of the present invention.

Referring now to FIGS. 1–4, there is generally shown a preferred embodiment of an eraser carrier of the present invention generally designated by reference numeral 11. The eraser carrier includes a holder portion 12 which is designed to receive an eraser 6 which is generally shown in broken lines. The eraser is shown to depict a common chalkboard eraser that normally has a rectangular top plate 7 and a body portion 8 that is intended to be used as an erasing surface. The holder portion 12 comprises a top member 13 and two sidewalls 17 which are integrally connected to the top member and which depend from the periphery of the top member. Extending from the inner surface 18 of the sidewalls 17 are rounded projections 19 which are intended to frictionally engage the body portion of the eraser 6. The particular relative thickness of the top member 13 and the sidewalls 17 may be chosen to permit some flexure of the holder portion or holder 12 to accommodate variations in eraser size. For example, as shown in FIG. 1, the sidewalls 17 are thicker than the top member 13 so that if a larger than normal eraser is inserted into the holder portion 12 of the carrier 11, the top member will tend to flex more than the sidewalls to accommodate the eraser. This will tend to maintain resiliency in the overall holder portion as compared to an eraser holder having relatively narrow sidewalls that may become in elastically stretched when they are required to both support oversize erasers and undergo high localized stress concentrations during erasing operations.

Figure 2:
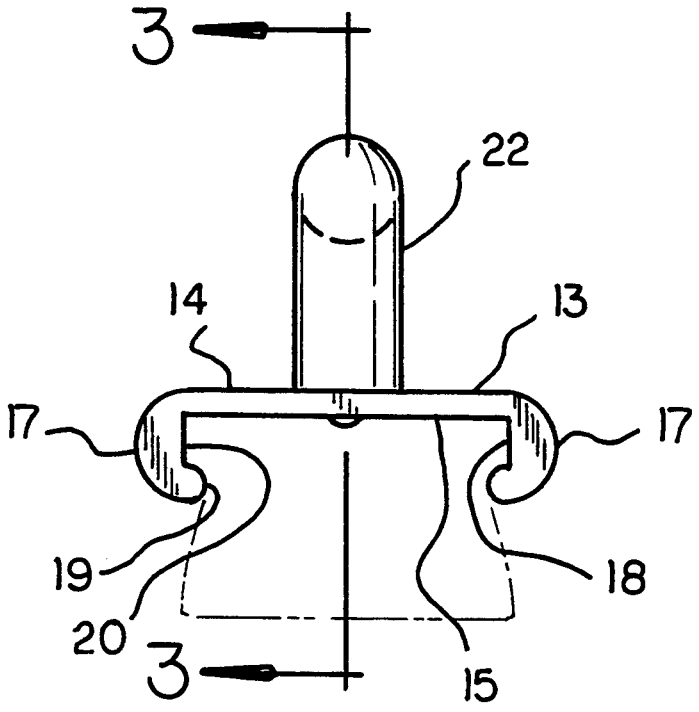
FIG. 2 is an end view taken generally along line 2—2 of FIG. 1 showing an eraser inserted into the eraser carrier of the present invention.

The relative dimensions of the sidewalls 17 and the projections 19 are configured so that the projections will normally engage the body portion 8 of the eraser. As shown in FIGS. 1 and 2, the projections 19 are rounded to form a thickened but gradual frictional transition surface and to define recesses 20 for receiving the longitudinal edges of the upper portion of the eraser. The rounded projections 19 tend to resiliently engage the eraser 6 so that grooves do not tend to develop in an eraser which may allow the eraser to readily slide out of or slip from an eraser holder. Also, the resilient, frictional surfaces formed by the rounded projections 19 and defined recesses 20 enable the holder 12 to receive erasers of different constructions and varying sizes. Further, the thickened sidewalls 17 and projections 19 cooperatively interact with a biasing means, later described, to maintain an eraser at a fixed predetermined position within the holder.

As further shown in FIGS. 1 through 4, a handle 22 is secured to the upper surface 14 of the top member to allow the user to maintain their hands away from the surface of the chalkboard. The handle 22 is generally L-shaped and it includes a first member 23 which extends generally normal to the upper surface of the top member of the holder and an elongated second member 24 which is integrally formed therewith and which extends generally parallel to the upper surface of the top member. A means for connecting the handle 22 to the holder 12 is depicted in FIGS. 3 and 4 where a threaded connecting clement or screw 25 is passed through the top member to threadedly engage the first member of the handle. The threaded connecting element 25 may be provided with a raised element 26 that is designed to engage the top plate of the eraser and form a means for biasing the eraser against the sidewalls and projections of the holder and thereby assist in maintaining the eraser at a fixed predetermined position within the holder.

Figure 5:
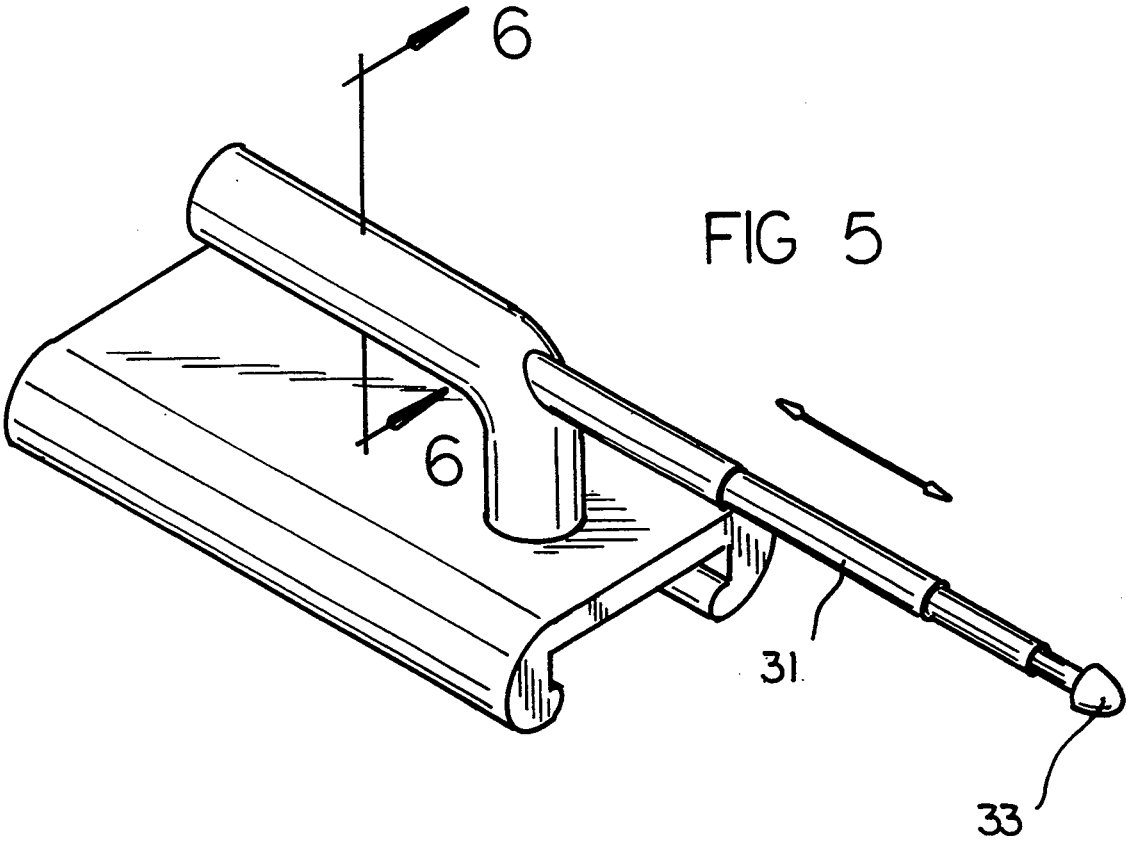
FIG. 5 is a perspective view of a modified form of the invention in which the eraser carrier is provided with an extensible pointer.
Figure 6:
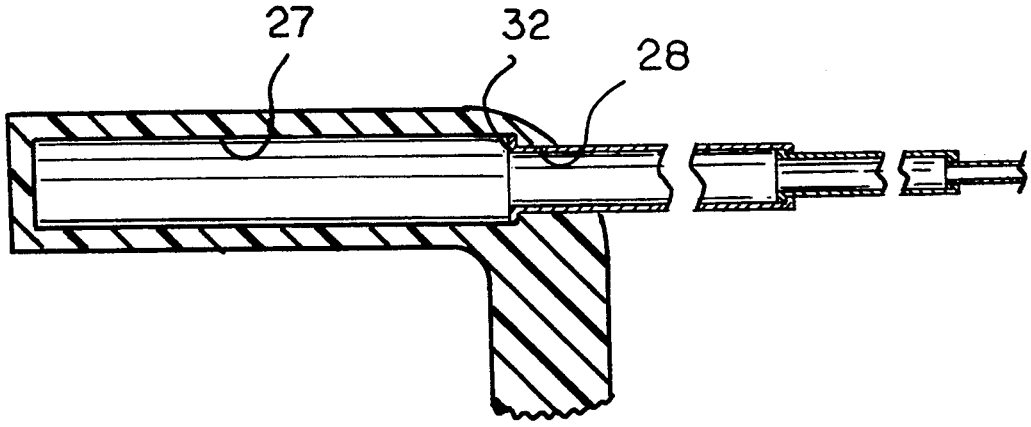
FIG. 6 is a section view taken generally along line 6—6 of FIG. 5.

FIGS. 5 and 6 depict a modified structure in which the handle 22 of the eraser holder is provided with an extensible/collapsible pointer. As shown in FIG. 6, the elongated second member 24 has a hollow section 27 formed therein and a passageway 28 which communicates with the hollow section. The extensible pointer 31 of FIGS. 5 and 6 has an enlarged base portion 32 at one end thereof and a tip 33 at the other end portion. When the extensible pointer 31 is inserted into the hollow section 27 of the handle, the diameter of the base approximates the diameter of the hollow section but it is, by design, smaller than the diameter of the passageway 28 so that as the pointer is pulled to its extended position the base portion moves to the location generally shown in FIG. 6, where it remains contained within the hollow section 27 the handle 22.

Figure 7:
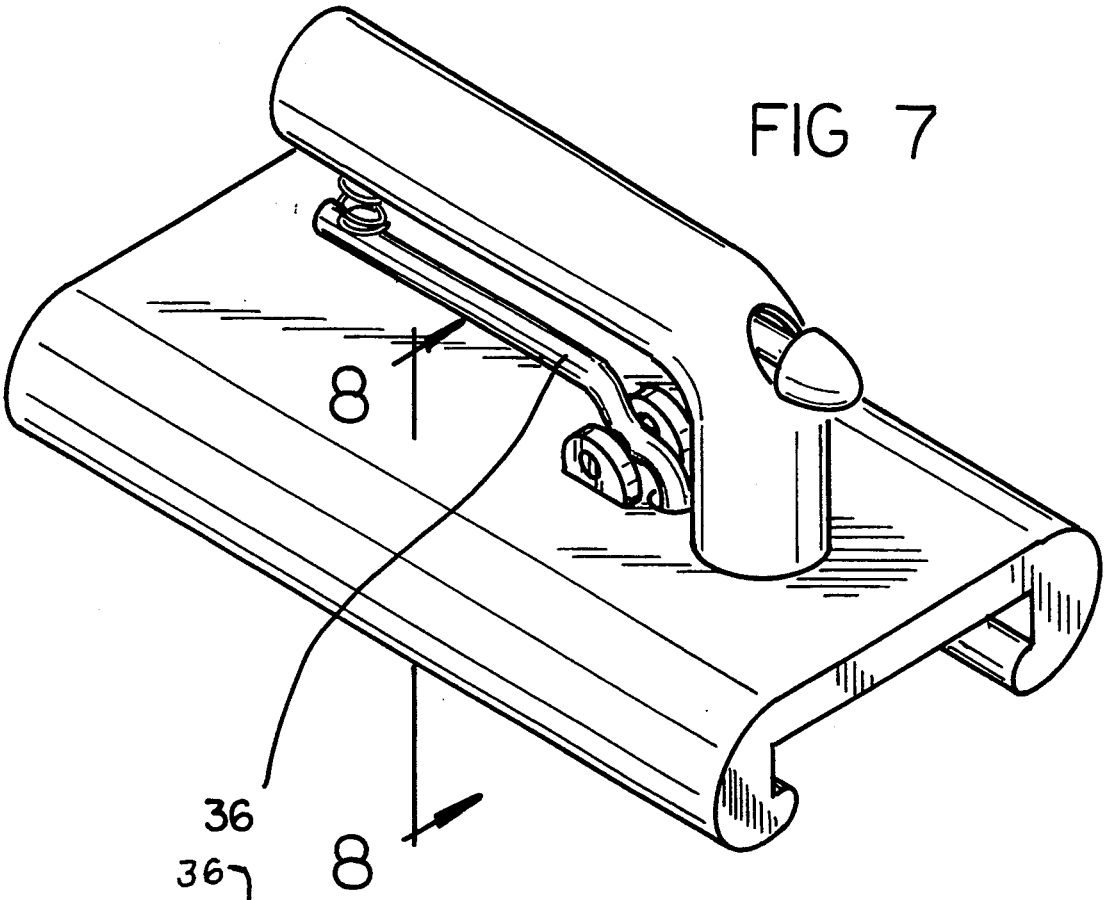
FIG. 7 is a perspective view showing a further modification in which a biasing lever is provided for engaging an eraser.
Figure 8:
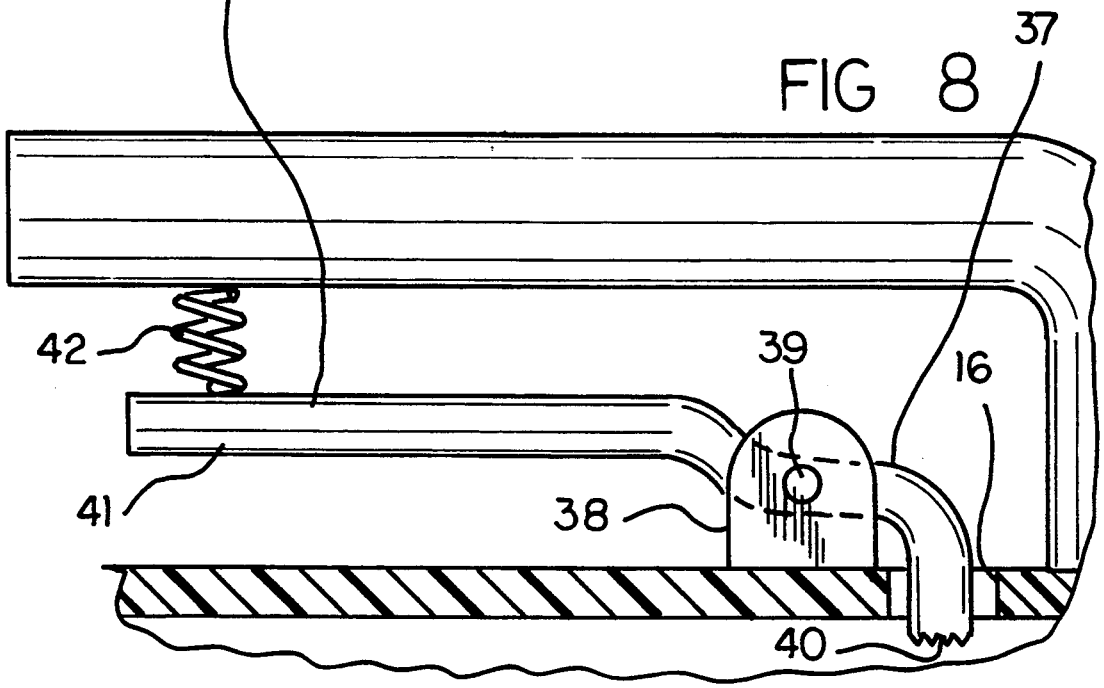
FIG. 8 is a section view taken generally along line 8—8 of FIG. 7.

FIGS. 7 and 8 show an alternatively preferred modification of the present invention whereby the holder 12 is provided with a lever assembly for selectively engaging the top plate of the eraser. The lever assembly includes an elongated lever 36 having a first end portion 37 which is pivotally connected to the holder 12 and a second end portion 41 which extends generally parallel to the second end of the handle. A pivotal connection is formed by positioning the first end portion 37 of the lever between a pair of spaced lugs 38 and inserting a pivot rod 39 through openings formed in the lugs and the first end portion of the lever. The first end portion of the lever is curved downwardly to extend through an opening 16 formed in the top member 13 of the eraser holder 12, so that as the lever is pivoted, a roughened surface 40 of the first end portion 37 of the lever positively engages the top plate or upper surface of the eraser 6. The second end of the lever is spaced apart from the handle by a biasing spring 42.

In use, as the user grasps the handle 22 and lever 36 and then squeezes the lever toward the handle, the first end portion 37 of the lever pivots through the opening 16 to engage the eraser 6. This will tend to press the eraser against the surfaces of the sidewalls 17 and projections 19 and thereby hold the eraser in place within the holder, particularly in those cases where the eraser is smaller than expected or where the eraser has slick surfaces which would normally allow the eraser to slip in the holder.

While the present invention has been shown in the drawings and fully described above with particularity and detail in connection with what is presently deemed to be the most practical and preferred embodiments of the invention, it will be apparent to those or ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. An eraser carrier, comprising:

a holder portion for receiving an eraser, the holder portion having a generally C-shaped cross-section and the holder portion including a generally rectangular-shaped top member having upper and lower surfaces, sidewalls connected to opposed edges of the top member to form an elongated channel for receiving the eraser, the sidewalls having inner and outer surfaces, and projections formed on the inner surfaces of the sidewalls for engaging the eraser to maintain the eraser in a fixed predetermined position;

a handle connected to the top surface of the holder portion for allowing the user to conveniently grasp the eraser carrier, the handle including a first member connected to the upper surface of the top member, and an elongated second member connected to the first member at an angle to the first member; and an elongated collapsible pointer having a base at one end of the collapsible pointer and a tip formed at the other end of the collapsible pointer, the base of the collapsible pointer secured to the second member of the handle.

2. The eraser carrier according to claim 1, wherein the first member of the handle extends generally perpendicular to the upper surface of the top member.

3. The eraser carrier according to claim 2, wherein the second member of the handle extends generally parallel to the upper surface of the top member.

4. The eraser carrier according to claim 3, wherein the handle has a hollow section formed therein and an opening which communicates with the hollow section, and the base of the collapsible pointer is inserted into the hollow section of the handle and connected to the handle so that when the collapsible pointer is pulled to its extended position, the collapsible pointer projects through the opening in the handle.

5. The eraser carrier according to claim 4, further comprising projections formed on the sidewalls and the top member for resiliently engaging the eraser to maintain the eraser at a fixed predetermined position in the holder portion.

6. The eraser carrier according to claim 4, further comprising projections formed on the distal edge portion of the sidewalls, remote from the top member.

7. The eraser carrier according to claim 6, wherein the projections have curved surfaces.

8. A chalkboard eraser carrier, comprising:

a holder for receiving an eraser, the holder having a generally C-shaped cross-section and the holder including a generally rectangular-shaped top member having upper and lower surfaces, spaced sidewalls connected to opposed edges of the top member to form an elongated channel for receiving an eraser, the sidewalls having inner and outer surfaces, and projections formed on the inner surfaces of the sidewalls for engaging the eraser to maintain the eraser in a fixed predetermined position;

a handle connected to the top surface of the holder, the handle including a first member connected to the upper surface of the top member, and an elongated second member connected to the first member at an angle to the first member, wherein the first member of the handle extends generally perpendicular to the upper surface of the top member, wherein the second member of the handle is spaced from and extends generally parallel to the upper surface of the top member, and wherein the handle has a hollow section formed therein and an opening which communicates with the hollow section; and a collapsible pointer having a base at one end of the pointer and a tip formed at the other end of the pointer, the base of the collapsible pointer secured to the second member of the handle, wherein the base of the collapsible pointer is inserted into the hollow section of the handle and connected to the handle so that when the pointer is pulled to its extended position, the pointer projects through the opening in the handle.

9. The eraser carrier according to claim 8, wherein the projections are formed on the distal edge portions of the sidewalls remote from the top member for resiliently engaging the eraser to maintain the eraser at a fixed predetermined position in the holder.

10. The eraser carrier according to claim 8, wherein the handle is secured to a central portion of the upper surface of the top member.

11. A chalkboard eraser carrier, comprising:

a holder for receiving an eraser, the holder having a generally C-shaped cross-section and the holder including a top member having upper and lower surfaces, spaced sidewalls connected to the top member to form an elongated channel for receiving an eraser, the sidewalls having inner and outer surfaces, and projections formed on the inner surfaces of the sidewalls and the lower surface of the top member for engaging the eraser to maintain the eraser in a fixed predetermined position;

a handle connected to a central portion of the top surface of the holder, the handle including a first member fixed to the upper surface of the top member, and an elongated second member connected to the first member at an angle to the first member, wherein the second member of the handle is spaced from the upper surface of the top member; and pointing means secured to the handle for allowing the handle to be used as a pointer.

12. The eraser carrier according to claim 11, wherein the projections on the inner surfaces of the sidewalls are formed on the distal edge portions of the sidewalls remote from the top member.

13. The eraser carrier according to claim 11, wherein the pointing means comprises a collapsible pointer having a base at one end of the pointer and a tip formed at the other end of the collapsible pointer, the base of the collapsible pointer secured to the second member of the handle.

* * * * *